US012259212B1

(12) United States Patent
Lee et al.

(10) Patent No.: US 12,259,212 B1
(45) Date of Patent: Mar. 25, 2025

(54) FIREARM GRIP INSERT WITH SECONDARY LOCK

(71) Applicant: Strike IP, LLC, Las Vegas, NV (US)

(72) Inventors: Shanyao Lee, Las Vegas, NV (US); Hung-Ju Lee, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 18/432,107

(22) Filed: Feb. 5, 2024

Related U.S. Application Data

(60) Provisional application No. 63/443,934, filed on Feb. 7, 2023.

(51) Int. Cl.
*F41C 23/22* (2006.01)
*F41C 23/10* (2006.01)

(52) U.S. Cl.
CPC ..... *F41C 23/22* (2013.01); *F41C 23/10* (2013.01)

(58) Field of Classification Search
CPC ..... F41C 23/22; F41C 23/10; F41C 23/16
See application file for complete search history.

(56) References Cited

U.S. PATENT DOCUMENTS

| | | | | |
|---|---|---|---|---|
| 10,415,919 | B1 * | 9/2019 | Harrigan | F41C 23/10 |
| 2006/0096147 | A1 * | 5/2006 | Gussalli Beretta | F41C 23/10 42/71.02 |
| 2013/0205635 | A1 * | 8/2013 | Hines | F41C 23/16 42/71.02 |
| 2021/0172691 | A1 * | 6/2021 | Hsu | F41A 9/71 |

* cited by examiner

*Primary Examiner* — J. Woodrow Eldred
(74) *Attorney, Agent, or Firm* — Andy M. Han; Han IP PLLC

(57) ABSTRACT

A device implementable on a firearm includes a firearm grip configured to be held or gripped by a user of the firearm. The firearm grip includes a grip body and a grip insert. The grip body has a first end and a second end opposite the first end. The first end can mate with a surface of the firearm when the firearm grip is installed on the firearm. The second end has a void that can receive and accommodate the grip insert therein. The grip insert includes a first lock and a second lock. When in a first position, the first lock locks the grip insert in the void of the grip body. When in a second position, the first lock unlocks the grip insert such that the grip insert is removable from the grip body. The second lock is configured to lock the first lock in the first position.

20 Claims, 8 Drawing Sheets

FIREARM GRIP INSERT WITH SECONDARY LOCK

CROSS REFERENCE TO RELATED PATENT APPLICATION(S)

The present disclosure claims the priority benefit of U.S. Provisional Patent Application No. 63/443,934, filed 7 Feb. 2023, the content of which being herein incorporated by reference in its entirety.

TECHNICAL FIELD

The present disclosure is generally related to firearms and, more particularly, to a firearm grip insert with a secondary lock.

BACKGROUND

Unless otherwise indicated herein, approaches described in this section are not prior art to the claims listed below and are not admitted as prior art by inclusion in this section.

A firearm grip typically has a storage space and many designs on the market are configured with a storage insert for the grip. In order for a user to access the storage easily, the insert normally has a locking mechanism that is easy to unlock, and users can use their fingers or a simple tool to unlock the insert from the grip to access the grip's storage space. However, this design is not applicable or viable in all usage scenarios. For example, for a user who intends to secure a tracking device in the grip, there is a risk of the grip being accessed by unauthorized persons. As another example, if the locking mechanism could be easily unlocked, the locking mechanism could be disabled unintentionally due to movement/vibration or under certain conditions. Therefore, there is a need for a solution of a firearm grip insert with a secondary lock.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a firearm grip insert with a secondary lock. It is believed that various designs of a firearm grip insert with a secondary lock under various proposed schemes of the present disclosure may address or otherwise alleviate the aforementioned issues.

In one aspect, a device implementable on a firearm may include a firearm grip configured to be held or gripped by a user of the firearm. The firearm grip may include a grip body and a grip insert. The grip body may be configured with a first end and a second end opposite the first end. The first end may be configured to mate with a surface of the firearm when the firearm grip is installed on the firearm. The second end may have a void configured to receive and accommodate the grip insert therein. The grip insert may include a first lock and a second lock such that: (i) when in a first position, the first lock locks the grip insert in the void of the grip body; (ii) when in a second position, the first lock unlocks the grip insert such that the grip insert is removable from the void of the grip body; and (iii) the second lock is configured to lock the first lock in the first position.

In another aspect, a device implementable on a firearm may include a firearm grip configured to be held or gripped by a user of the firearm. The firearm grip may include a grip body and a grip insert. The grip insert may include a first lock and a second lock such that: (i) when in a first position, the first lock locks the grip insert in a void of the grip body; (ii) when in a second position, the first lock unlocks the grip insert such that the grip insert is removable from the void of the grip body; (iii) when locked in place, the second lock is configured to lock the first lock in the first position; and (iv) when the second lock is unlocked, the first lock is movable from the first position to the second position.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
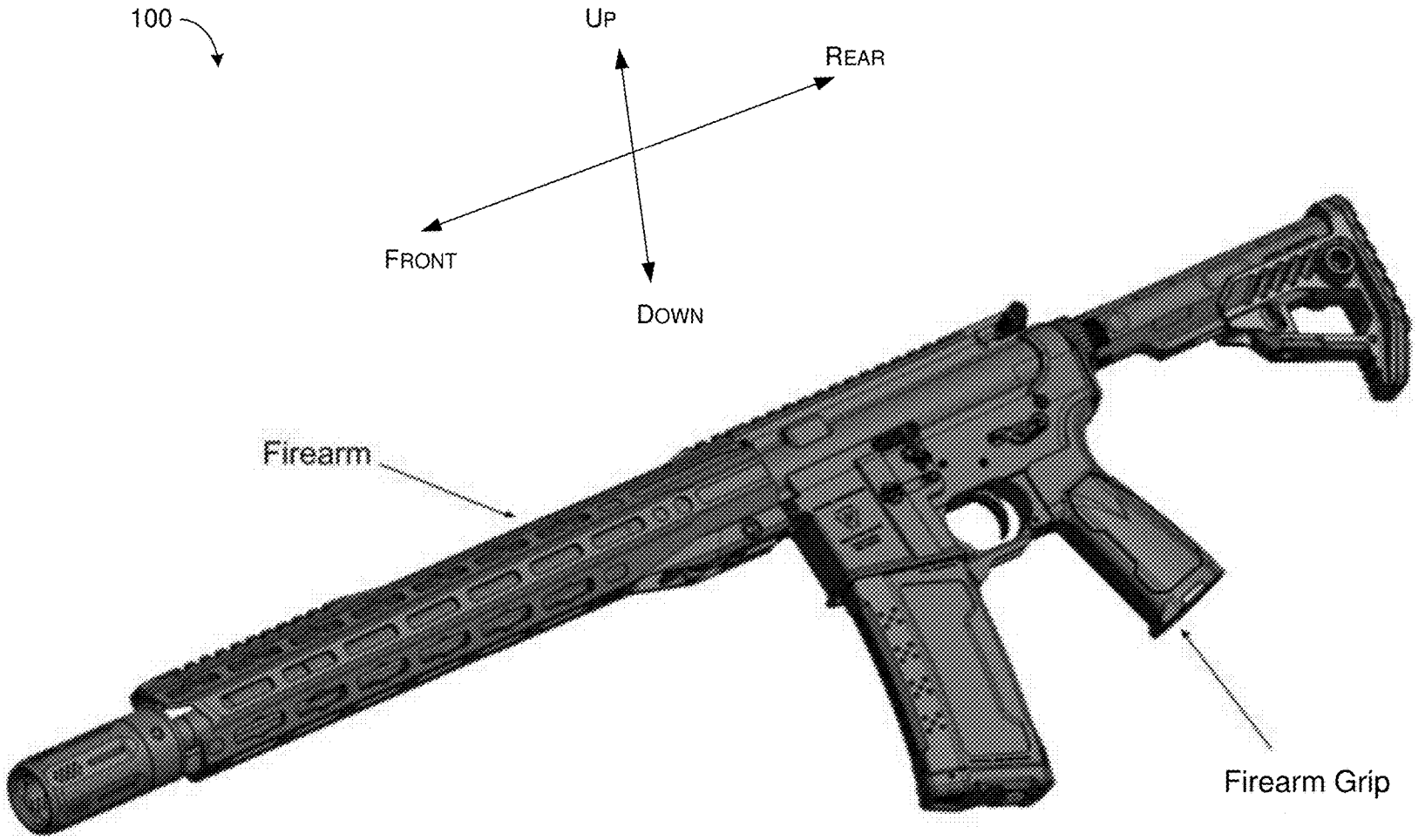
FIG. 1 is a diagram of an example view of a firearm grip under a proposed scheme in accordance with the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 8 regarding a firearm grip insert with a secondary lock under various proposed schemes in accordance with the present disclosure for a firearm. In some implementations, the firearm may be a pistol, such as a semiautomatic pistol. In other implementations, the firearm may be an AR-style firearm or an AK-style firearm, which may be a rifle, carbine, pistol or shotgun.

Under various proposed schemes in accordance with the present disclosure, a firearm grip may be configured with more than one locking mechanism, including a primary locking mechanism and a secondary locking mechanism. The primary locking mechanism (herein interchangeably referred to as the "first lock") may be the same as or similar to a conventional locking mechanism on existing designs of firearm grips, and the primary locking mechanism may be easy to unlock. The secondary locking mechanism (herein interchangeably referred to as the "second lock") may be designed to hold the primary locking mechanism to keep or otherwise prevent the primary locking mechanism from being easily unlocked. For instance, the secondary locking mechanism may be configured to block or otherwise prevent the primary locking mechanism from moving from a first position (which locks a storage space of the firearm grip) to a second position (which unlocks the storage space). Accordingly, a user would need to unlock the secondary locking mechanism first (e.g., with a tool) before unlocking the primary locking mechanism in order to access the storage space.

Figure 2:
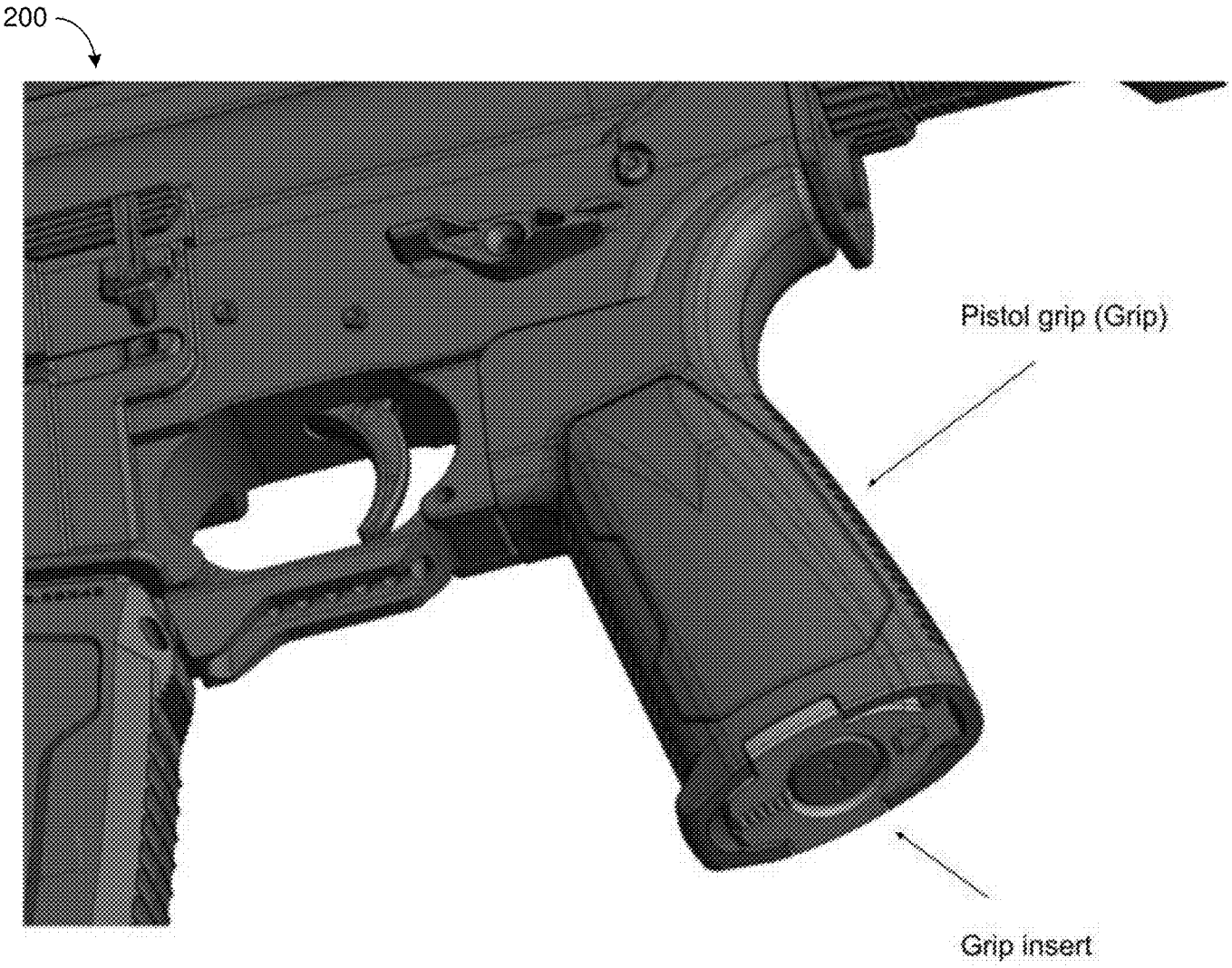
FIG. 2 is a diagram of an example view of a firearm grip under a proposed scheme in accordance with the present disclosure.

FIG. 1 illustrates an example view 100 of a firearm grip under a proposed scheme in accordance with the present disclosure (e.g., in the form of a pistol grip) being implemented or otherwise installed on a firearm (e.g., an AR-style or AK-style firearm as shown in FIG. 1). FIG. 2 illustrates an example view 200 of the firearm grip which includes a grip body, which constitutes a bulk portion of the firearm grip, and a grip insert, which is inserted or otherwise received in a void of the grip body. The grip body may be configured with a first end and a second end opposite the first end. The first end may be configured to mate with a surface of the firearm when the firearm grip is installed on the firearm. The second end may have a void configured to receive and accommodate the grip insert therein. In some implementations, a first side of the grip insert may be configured with a cavity which forms a storage space with the void of the grip body when the grip insert is received in the grip body.

Figure 3:
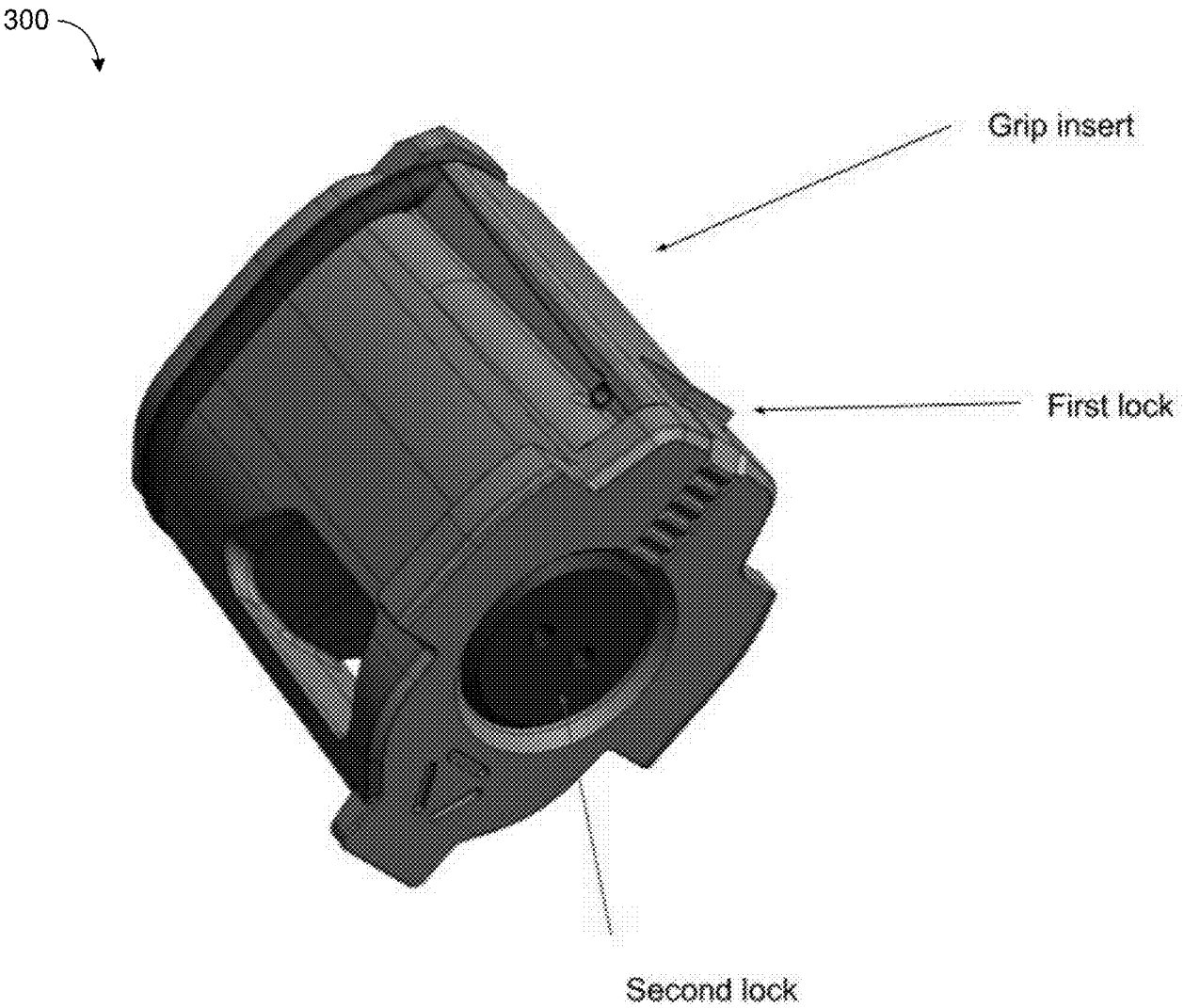
FIG. 3 is a diagram of an example view of a firearm grip under a proposed scheme in accordance with the present disclosure.
Figure 4:
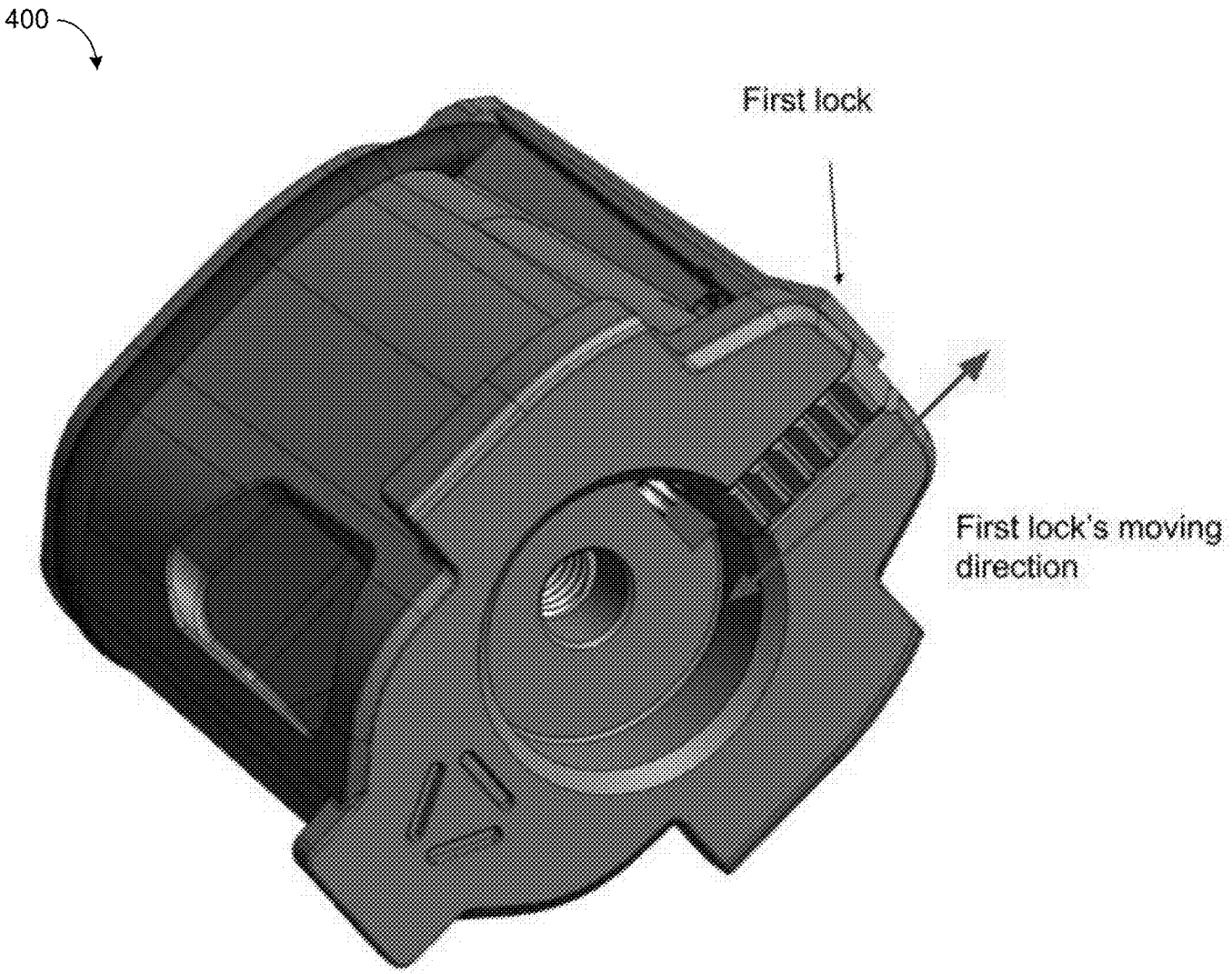
FIG. 4 is a diagram of an example view of a firearm grip under a proposed scheme in accordance with the present disclosure.
Figure 5:
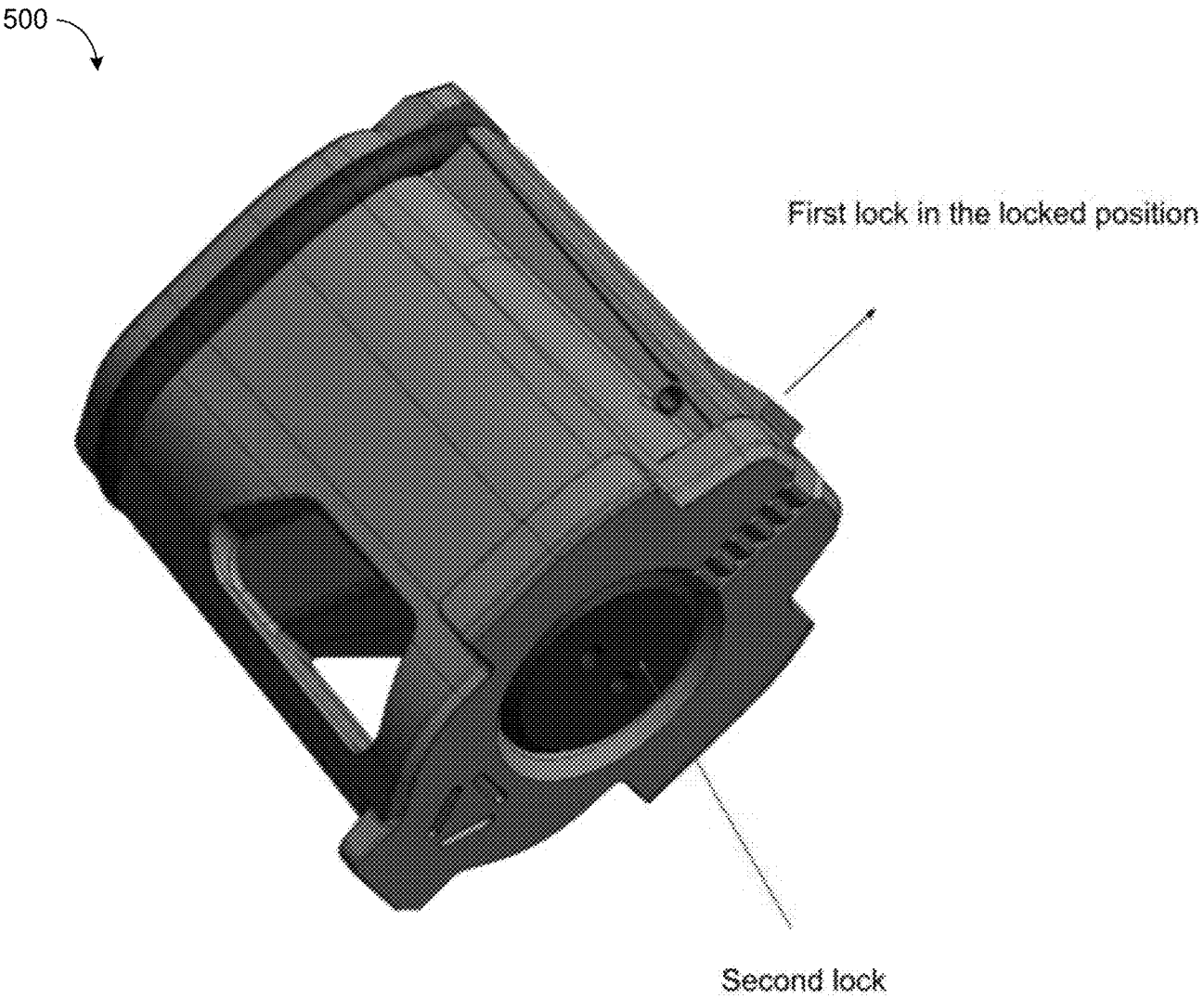
FIG. 5 is a diagram of an example view of a firearm grip under a proposed scheme in accordance with the present disclosure.

FIG. 3 illustrates an example view 300 of the grip insert. As shown in FIG. 3, the grip insert may be equipped or otherwise configured with a first lock (or primary locking mechanism) and a second lock (or secondary locking mechanism). When in place, the second lock may prevent any movement of the first lock by blocking a movement of the first lock from a first position (locking position) to a second position (unlocked position). FIG. 4 illustrates an example view 400 of the grip insert. As shown in FIG. 4, without the second lock (e.g., after the second lock is unlocked and removed by the user), the first lock may move freely and thus may be moved to the second position (unlocked position), thereby allowing the user to remove the grip insert from the void of the grip body and to access a storage space formed between the void of the grip body and a cavity on the grip insert. FIG. 5 illustrates an example view 500 of the grip insert. As shown in FIG. 5, with the grip insert received or otherwise accommodated in the void of the grip body and with the second lock in place (e.g., after the second lock is inserted and locked in place by the user), the second lock may stop or otherwise prevent any movement of the first lock by locking the first lock in its first position (locking position), thereby improving the security of access to the storage space within the firearm grip.

In some implementations, the firearm grip may be designed in the form of a pistol grip. Alternatively, the firearm grip may be designed in the form of a vertical grip. Still alternatively, the firearm grip may be designed in the form of an angled grip.

Figure 6:
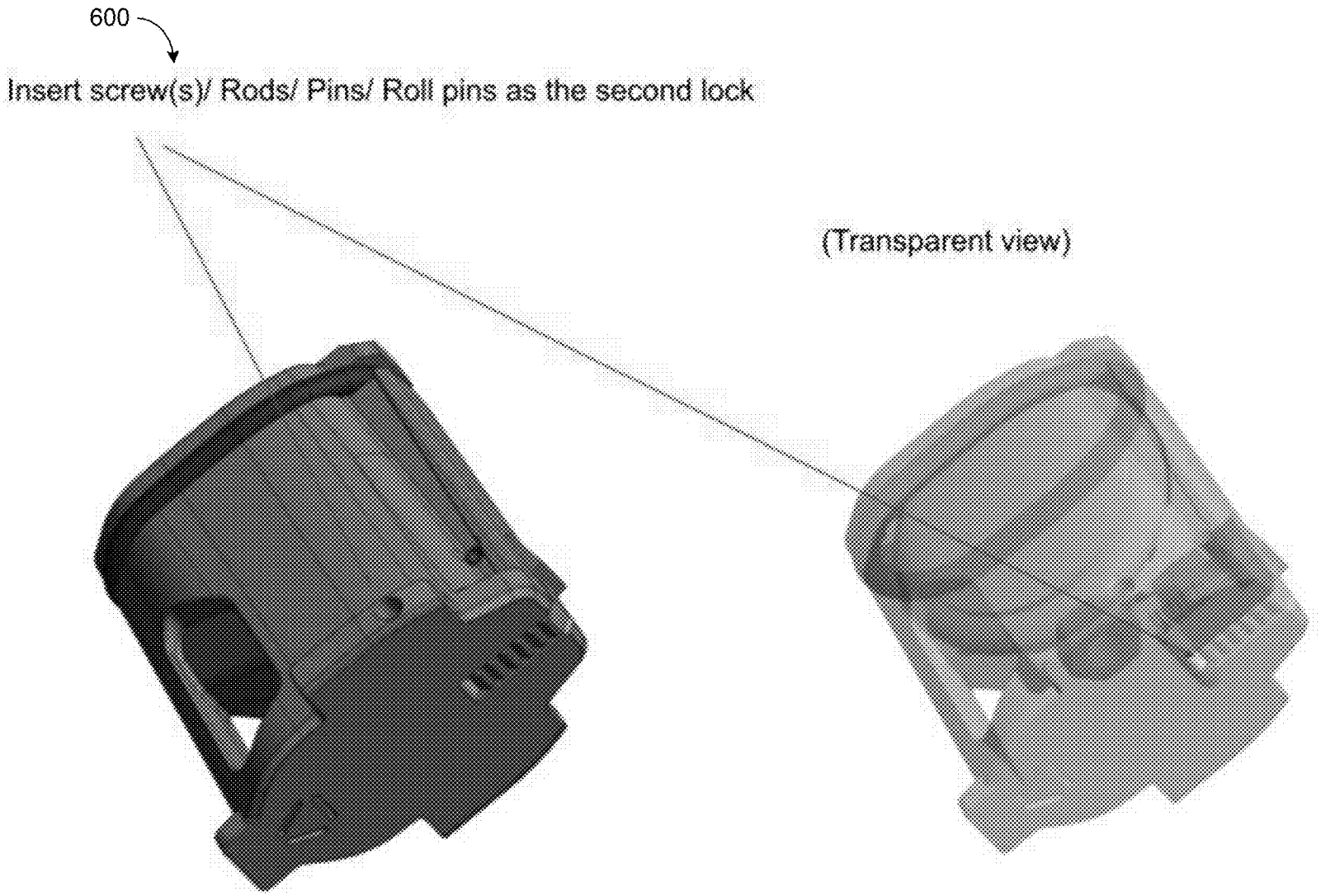
FIG. 6 is a diagram of an example implementation under a proposed scheme in accordance with the present disclosure.

FIG. 6 illustrates an example implementation 600 under a proposed scheme in accordance with the present disclosure. Referring to FIG. 6, the grip insert may include a first lock and a second lock such that: (i) when in a first position, the first lock locks the grip insert in a void of the grip body; (ii) when in a second position, the first lock unlocks the grip insert such that the grip insert is removable from the void of the grip body; (iii) when locked in place, the second lock is configured to lock the first lock in the first position; and (iv) when the second lock is unlocked, the first lock is movable from the first position to the second position. In implementation 600, the second lock may be removably receivable in a hole on an edge of the second side of the grip insert such that, when the second lock is inserted or received in the hole in a direction perpendicular to a movement of the first lock between the first position and the second position, the first lock is locked in the first position and prevented from moving to the second position. The second lock may include a screw, rod, pin or roll pin.

Figure 7:
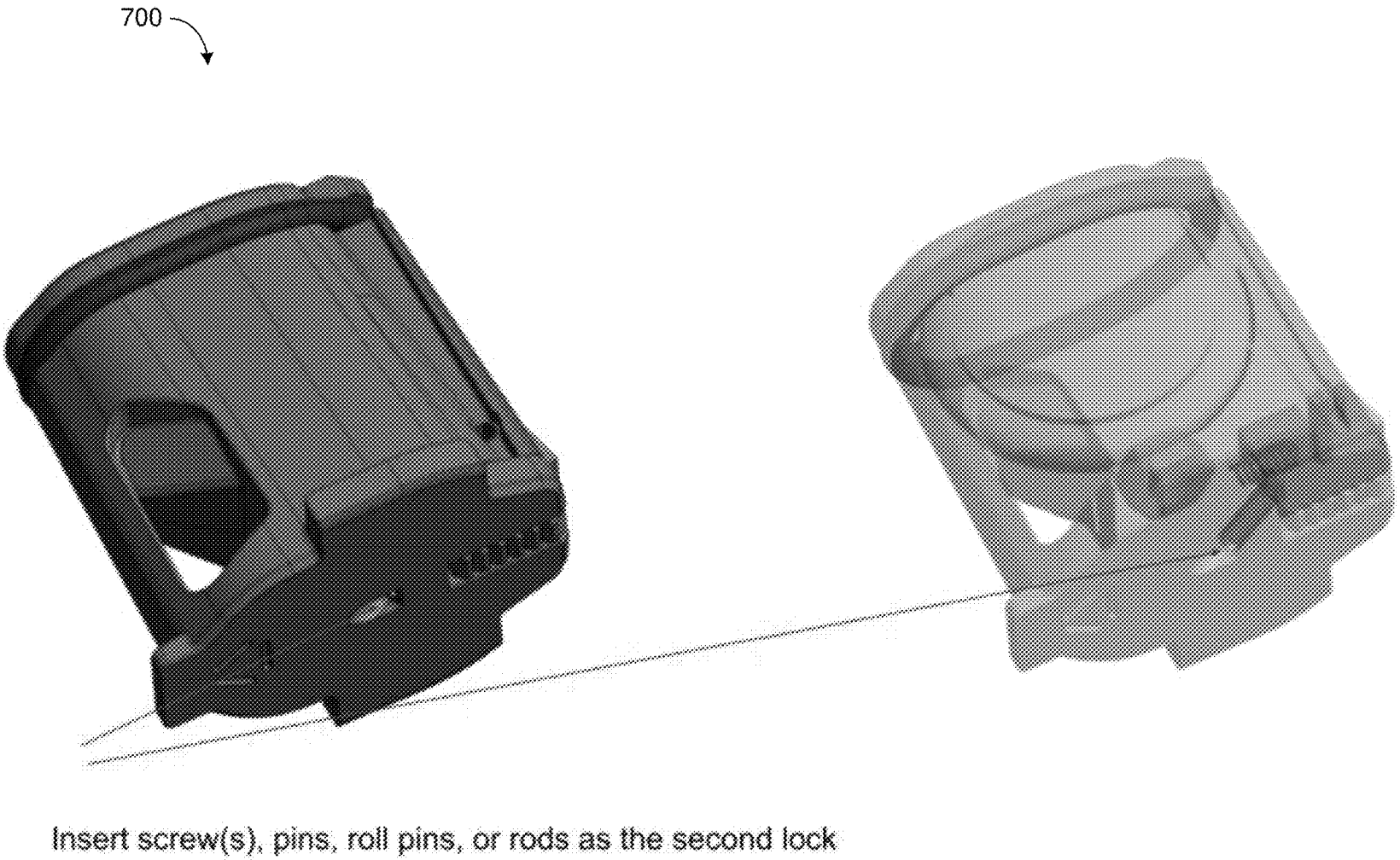
FIG. 7 is a diagram of an example implementation under a proposed scheme in accordance with the present disclosure.

FIG. 7 illustrates an example implementation 700 under a proposed scheme in accordance with the present disclosure. Referring to FIG. 7, the grip insert may include a first lock and a second lock such that: (i) when in a first position, the first lock locks the grip insert in a void of the grip body; (ii) when in a second position, the first lock unlocks the grip insert such that the grip insert is removable from the void of the grip body; (iii) when locked in place, the second lock is configured to lock the first lock in the first position; and (iv) when the second lock is unlocked, the first lock is movable from the first position to the second position. In implementation 700, the second lock may be removably receivable in an angled hole on the second side of the grip insert and traversing a portion of the grip insert at an angle other than 90° relative to the second side such that, when the second lock is inserted or received in the angled hole, the first lock is locked in the first position and prevented from moving to the second position. The second lock may include a screw, rod, pin or roll pin.

Figure 8:
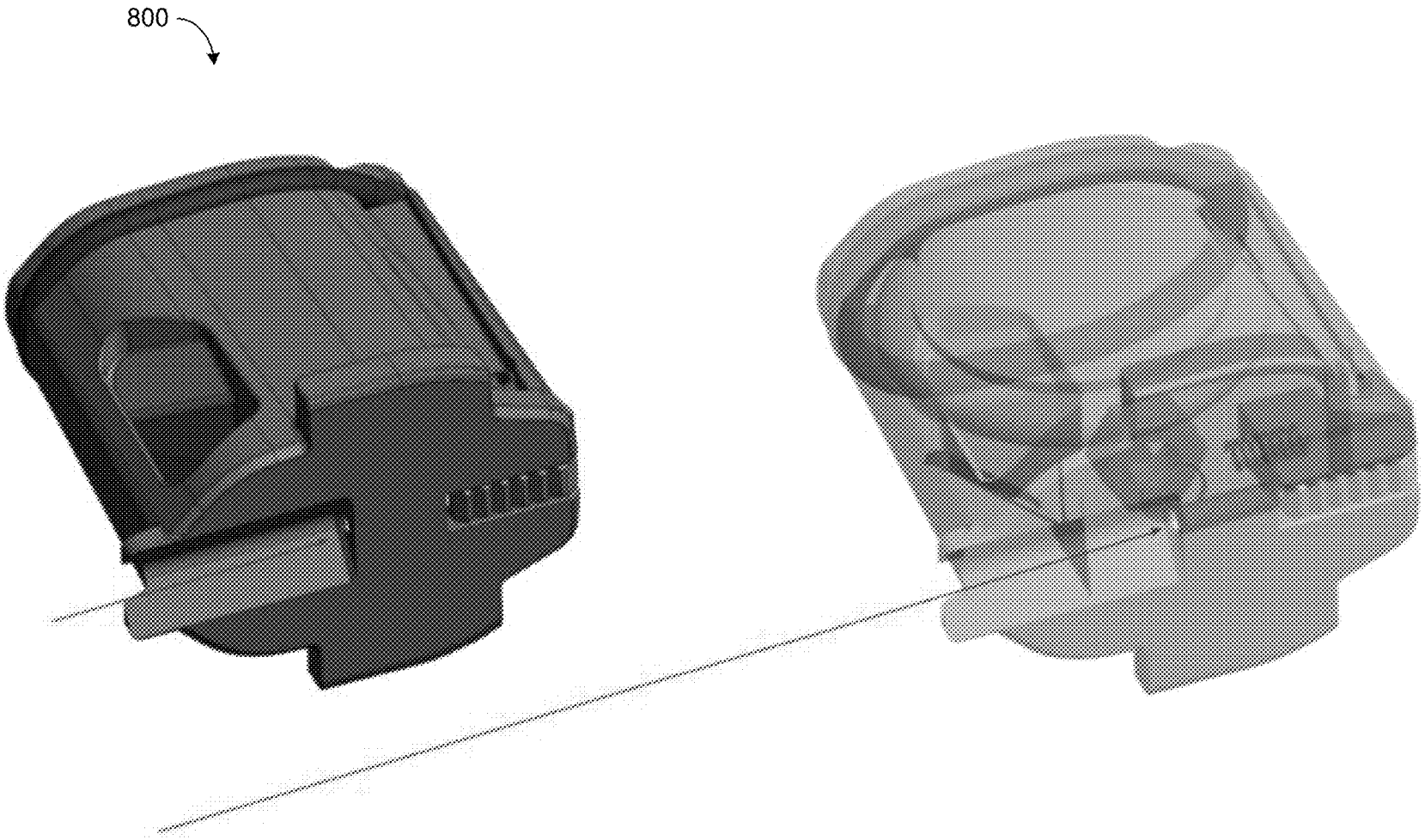
FIG. 8 is a diagram of an example implementation under a proposed scheme in accordance with the present disclosure.

FIG. 8 illustrates an example implementation 800 under a proposed scheme in accordance with the present disclosure. Referring to FIG. 8, the grip insert may include a first lock and a second lock such that: (i) when in a first position, the first lock locks the grip insert in a void of the grip body; (ii) when in a second position, the first lock unlocks the grip insert such that the grip insert is removable from the void of the grip body; (iii) when locked in place, the second lock is configured to lock the first lock in the first position; and (iv) when the second lock is unlocked, the first lock is movable from the first position to the second position. In implementation 800, the second lock may be removably receivable in a hole on an edge of the second side of the grip insert such that, when the second lock is inserted or received in the hole in a direction parallel to a movement of the first lock between the first position and the second position, the first lock is locked in the first position and prevented from moving to the second position. The second lock may include a screw, rod, pin or roll pin.

Highlight of Select Features

In view of the above, select features of various implementations in accordance with the present disclosure are highlighted below.

In one aspect, a device implementable on a firearm (e.g., an AR-style or AK-style rifle, carbine, pistol or shotgun) may include a firearm grip configured to be held or gripped by a user of the firearm. The firearm grip may include a grip body and a grip insert. The grip body may be configured with a first end and a second end opposite the first end. The first end may be configured to mate with a surface of the firearm when the firearm grip is installed on the firearm. The second end may have a void configured to receive and accommodate the grip insert therein. The grip insert may include a first lock and a second lock such that: (i) when in a first position, the first lock locks the grip insert in the void of the grip body; (ii) when in a second position, the first lock unlocks the grip insert such that the grip insert is removable from the void of the grip body; and (iii) the second lock is configured to lock the first lock in the first position.

In some implementations, a first side of the grip insert may be configured with a cavity which forms a storage space with the void of the grip body when the grip insert is received in the grip body.

In some implementations, the first lock may be movable between the first position and the second position on a second side of the grip insert opposite the first side thereof.

In some implementations, the second lock may include a screw, rod, pin or roll pin.

In some implementations (e.g., as shown in FIG. 6), the second lock may be removably receivable in a hole on an edge of the second side of the grip insert such that, when the second lock is inserted or received in the hole in a direction perpendicular to a movement of the first lock between the first position and the second position, the first lock is locked in the first position and prevented from moving to the second position.

In some implementations (e.g., as shown in FIG. 7), the second lock may be removably receivable in an angled hole on the second side of the grip insert and traversing a portion of the grip insert at an angle other than 90° relative to the second side such that, when the second lock is inserted or received in the angled hole, the first lock is locked in the first position and prevented from moving to the second position.

In some implementations (e.g., as shown in FIG. 8), the second lock may be removably receivable in a hole on an edge of the second side of the grip insert such that, when the second lock is inserted or received in the hole in a direction parallel to a movement of the first lock between the first position and the second position, the first lock is locked in the first position and prevented from moving to the second position.

In some implementations, the firearm grip may include a pistol grip. Alternatively, the firearm grip may include a vertical grip. Still alternatively, the firearm grip may include an angled grip.

In another aspect, a device implementable on a firearm (e.g., an AR-style or AK-style rifle, carbine, pistol or shotgun) may include a firearm grip configured to be held or gripped by a user of the firearm. The firearm grip may include a grip body and a grip insert. The grip insert may include a first lock and a second lock such that: (i) when in a first position, the first lock locks the grip insert in a void of the grip body; (ii) when in a second position, the first lock unlocks the grip insert such that the grip insert is removable from the void of the grip body; (iii) when locked in place, the second lock is configured to lock the first lock in the first position; and (iv) when the second lock is unlocked, the first lock is movable from the first position to the second position.

In some implementations, a first side of the grip insert may be configured with a cavity which forms a storage space with the void of the grip body when the grip insert is received in the grip body.

In some implementations, the first lock may be movable between the first position and the second position on a second side of the grip insert opposite the first side thereof.

In some implementations, the second lock may include a screw, rod, pin or roll pin.

In some implementations (e.g., as shown in FIG. 6), the second lock may be removably receivable in a hole on an edge of the second side of the grip insert such that, when the second lock is inserted or received in the hole in a direction perpendicular to a movement of the first lock between the first position and the second position, the first lock is locked in the first position and prevented from moving to the second position.

In some implementations (e.g., as shown in FIG. 7), the second lock may be removably receivable in an angled hole on the second side of the grip insert and traversing a portion of the grip insert at an angle other than 90° relative to the second side such that, when the second lock is inserted or received in the angled hole, the first lock is locked in the first position and prevented from moving to the second position.

In some implementations (e.g., as shown in FIG. 8), the second lock may be removably receivable in a hole on an edge of the second side of the grip insert such that, when the second lock is inserted or received in the hole in a direction parallel to a movement of the first lock between the first position and the second position, the first lock is locked in the first position and prevented from moving to the second position.

In some implementations, the firearm grip may include a pistol grip. Alternatively, the firearm grip may include a vertical grip. Still alternatively, the firearm grip may include an angled grip.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a firearm grip configured to be held or gripped by a user of the firearm, the firearm grip comprising a grip body and a grip insert, wherein the grip body comprises a first end and a second end opposite the first end, the first end configured to mate with a surface of the firearm when the firearm grip is installed on the firearm, the second end having a void configured to receive and accommodate the grip insert therein, and wherein the grip insert comprises a first lock and a second lock such that:

when in a first position, the first lock locks the grip insert in the void of the grip body;

when in a second position, the first lock unlocks the grip insert such that the grip insert is removable from the void of the grip body; and the second lock is configured to lock the first lock in the first position.

2. The device of claim 1, wherein a first side of the grip insert is configured with a cavity which forms a storage space with the void of the grip body when the grip insert is received in the grip body.

3. The device of claim 2, wherein the first lock is movable between the first position and the second position on a second side of the grip insert opposite the first side thereof.

4. The device of claim 3, wherein the second lock comprises a screw, rod, pin or roll pin.

5. The device of claim 4, wherein the second lock is removably receivable in a hole on an edge of the second side of the grip insert such that, when the second lock is inserted or received in the hole in a direction perpendicular to a movement of the first lock between the first position and the second position, the first lock is locked in the first position and prevented from moving to the second position.

6. The device of claim 4, wherein the second lock is removably receivable in an angled hole on the second side of the grip insert and traversing a portion of the grip insert at an angle other than 90° relative to the second side such that, when the second lock is inserted or received in the angled hole, the first lock is locked in the first position and prevented from moving to the second position.

7. The device of claim 4, wherein the second lock is removably receivable in a hole on an edge of the second side of the grip insert such that, when the second lock is inserted or received in the hole in a direction parallel to a movement of the first lock between the first position and the second position, the first lock is locked in the first position and prevented from moving to the second position.

8. The device of claim 1, wherein the firearm grip comprises a pistol grip.

9. The device of claim 1, wherein the firearm grip comprises a vertical grip.

10. The device of claim 1, wherein the firearm grip comprises an angled grip.

11. A device implementable on a firearm, comprising:

a firearm grip configured to be held or gripped by a user of the firearm, the firearm grip comprising a grip body and a grip insert, wherein the grip insert comprises a first lock and a second lock such that:

when in a first position, the first lock locks the grip insert in a void of the grip body;

when in a second position, the first lock unlocks the grip insert such that the grip insert is removable from the void of the grip body;

when locked in place, the second lock is configured to lock the first lock in the first position; and when the second lock is unlocked, the first lock is movable from the first position to the second position.

12. The device of claim 11, wherein a first side of the grip insert is configured with a cavity which forms a storage space with the void of the grip body when the grip insert is received in the grip body.

13. The device of claim 12, wherein the first lock is movable between the first position and the second position on a second side of the grip insert opposite the first side thereof.

14. The device of claim 13, wherein the second lock comprises a screw, rod, pin or roll pin.

15. The device of claim 14, wherein the second lock is removably receivable in a hole on an edge of the second side of the grip insert such that, when the second lock is inserted or received in the hole in a direction perpendicular to a movement of the first lock between the first position and the second position, the first lock is locked in the first position and prevented from moving to the second position.

16. The device of claim 14, wherein the second lock is removably receivable in an angled hole on the second side of the grip insert and traversing a portion of the grip insert at an angle other than 90° relative to the second side such that, when the second lock is inserted or received in the angled hole, the first lock is locked in the first position and prevented from moving to the second position.

17. The device of claim 14, wherein the second lock is removably receivable in a hole on an edge of the second side of the grip insert such that, when the second lock is inserted or received in the hole in a direction parallel to a movement of the first lock between the first position and the second position, the first lock is locked in the first position and prevented from moving to the second position.

18. The device of claim 11, wherein the firearm grip comprises a pistol grip.

19. The device of claim 11, wherein the firearm grip comprises a vertical grip.

20. The device of claim 11, wherein the firearm grip comprises an angled grip.

* * * * *